US005566948A

United States Patent [19]

Kidd

[11] Patent Number: 5,566,948

[45] Date of Patent: Oct. 22, 1996

[54] BOUNCING BALL GAME

[76] Inventor: Bobby D. Kidd, 1906 E. 47th St., Texarkana, Ark. 75502

[21] Appl. No.: 652,826

[22] Filed: May 23, 1996

[51] Int. Cl.[6] ..... A63B 67/00

[52] U.S. Cl. ..... 273/342; 273/428

[58] Field of Search ..... 273/342, 428

[56] References Cited

U.S. PATENT DOCUMENTS

| | | | |
|---|---|---|---|
| 453,310 | 6/1891 | Reed | 273/401 |
| 642,903 | 2/1900 | Hachmuth | 273/401 |
| 689,054 | 12/1901 | Bauer | 273/342 |
| 742,416 | 10/1903 | Hall | 273/398 |
| 823,507 | 6/1906 | Carr | 273/401 |
| 1,616,270 | 2/1927 | Madden | 273/342 X |
| 2,126,873 | 4/1936 | Czajkowski | 273/400 |
| 2,301,265 | 4/1941 | Fandrey | 273/342 |
| 2,481,724 | 6/1948 | Croteau | 273/342 X |
| 3,099,450 | 8/1961 | Randall | 273/424 |
| 3,822,063 | 7/1974 | Rea | 273/400 |
| 4,181,302 | 1/1980 | Sexton et al. | 273/342 |
| 4,726,592 | 2/1988 | Callaham | 273/342 |
| 4,863,175 | 9/1989 | Ricks, Jr. et al. | 273/342 |
| 4,986,549 | 1/1991 | Kuhtic et al. | 273/402 |
| 5,351,968 | 10/1994 | Starnes | 273/400 X |

*Primary Examiner*—William H. Grieb

*Attorney, Agent, or Firm*—Mark Rogers; Gary N. Speed

[57] ABSTRACT

A game apparatus and method are disclosed which utilize a game apparatus with a target area having an upper face with an aperture passing therethough. Bumps are disposed on the upper face of the target area, and a lip is disposed about an outer edge of the target area, extending above the upper face. The lip has slots extending downward from its upper edge. A base supports the target area above a playing surface. Irregularly shaped balls, such as balls in the shape of one-half of a sphere or three-forths of a sphere, may be used. The irregularly shaped ball is held such that, when the ball is propelled toward the playing surface with substantially no horizontal force, the ball nonetheless bounces towed the target area. A base retains balls that are bounced through the aperture in the target area, and vents in the base provide a view of the balls contained therein and provides for savings in material costs.

20 Claims, 2 Drawing Sheets

BOUNCING BALL GAME

BACKGROUND OF THE INVENTION

This invention relates to a game apparatus and method, and more particularly, to a game apparatus and method using a bouncing ball.

There are a wide variety of games in which balls or other objects are thrown or bounced toward a target, such as a basket or base. Such games typically provide entertainment and require varying degrees of skill and dexterity. When bounced, a spherical ball provides predictable action and requires a player to apply horizontal force to bounce the ball toward the target. Games in which balls are thrown or bounced toward a target also require a relatively large amount of space, and targets often lack the ability to collect or retain balls.

SUMMARY OF THE INVENTION

It is therefore an object of the present invention to provide a game apparatus and method calling for skill and dexterity in bouncing a ball toward a target area.

It is a further object of the present invention to provide an apparatus and method of the above type in which obstacles on and around the target area provide for erratic action of a ball or game piece thrown or bounced toward the target area.

It is a still further object of the present invention to provide an apparatus and method of the above type in which irregularly shaped balls are used to make ball action more erratic and less predictable.

It is a still further object of the present invention to provide an apparatus and method of the above type in which a relatively small area is required for play.

It is a still further object of the present invention to provide an apparatus and method of the above type in which a ball propelled with substantially no horizontal force will nonetheless move in a horizontal direction toward a target area after striking a playing surface.

Toward the fulfillment of these and other objects and advantages, the game apparatus and method of the present invention uses a game apparatus with a target area having an upper face with an aperture passing therethrough. Bumps are disposed on the upper face of the target area, and a lip is disposed about an outer edge of the target area, extending above the upper face. The lip has a plurality of slots extending downwardly from its upper edge. A base supports the target area above a playing surface. Irregularly shaped balls, such as balls in the shape of one-half of a sphere or three-fourths of a sphere, may be used. The irregularly shaped ball is held such that, when the ball is propelled toward the playing surface with substantially no horizontal force, the ball nonetheless bounces toward the target area. A base retains balls that are bounced through the aperture in the target area, and vents in the base provide a view of the balls contained therein and provides for savings in material costs.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings, wherein.

DETAILED DESCRIPTION OF THE PREFERRED EMBODIMENT

Figure 1:
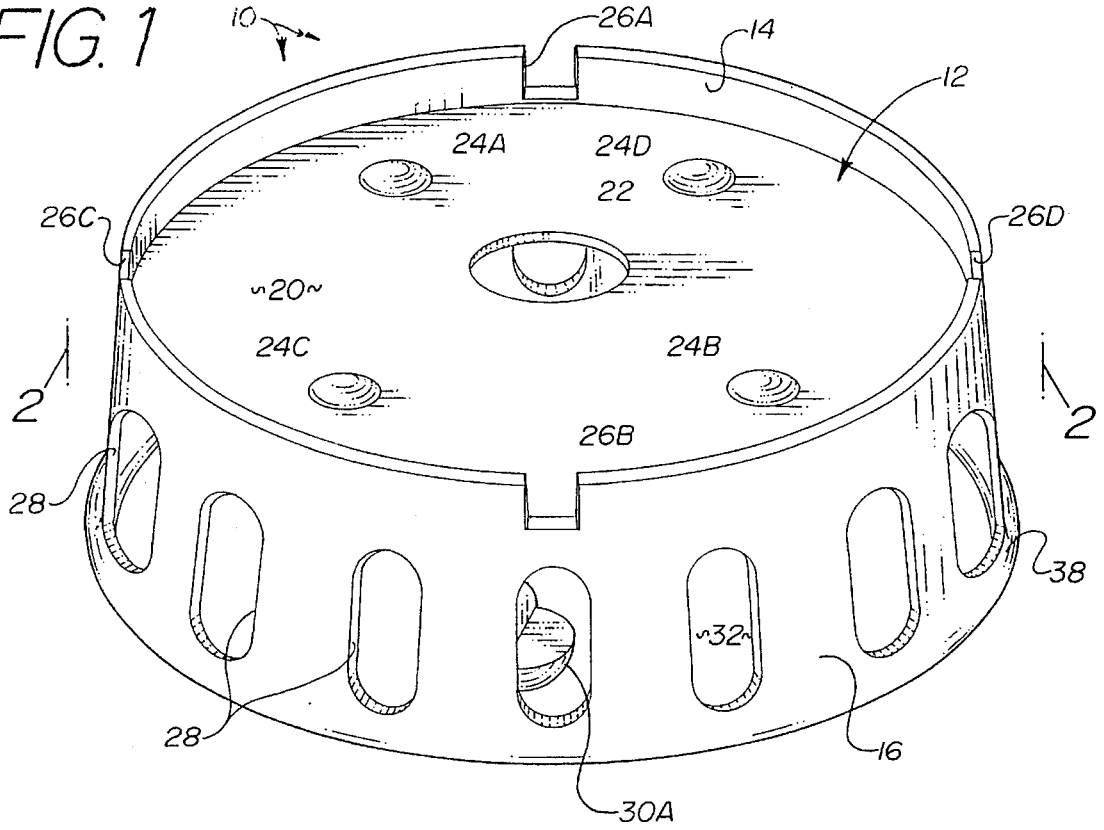
FIG. 1 is a perspective of a game apparatus of the present invention.
Figure 2:
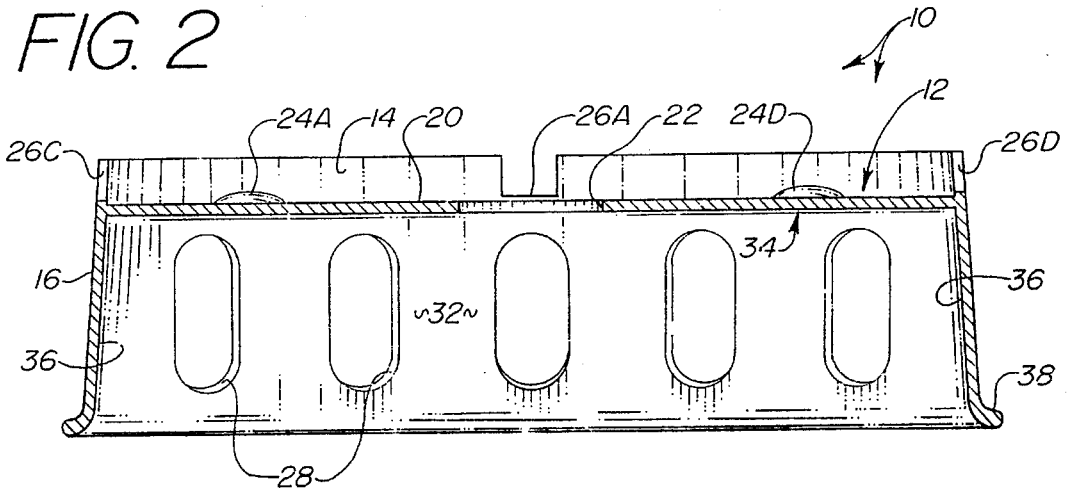
FIG. 2 is a partial sectional view taken along line 2—2 of the game apparatus of FIG. 1.
Figure 3:
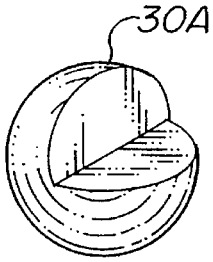
FIG. 3 is a perspective view of an irregularly shaped ball in the shape of three-fourths of a sphere that may be used in playing a game of the present invention.
Figure 4:
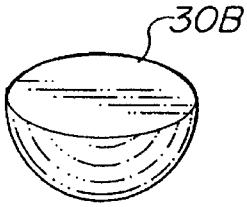
FIG. 4 is a perspective view of an irregularly shaped ball in the shape of one-half of a sphere that may be used in playing a game of the present invention.

Referring to FIG. 1, the reference numeral 10 refers in general to a game apparatus of the present invention. The apparatus 10 has a target area 12, a lip 14 disposed around and above the target area 12, and a base 16 that supports the target area 12 above a playing surface 18, such as a table top, floor, driveway, sidewalk, game board or other hard surface.

The target area 12 is circular and has a flat, planar, horizontal upper face 20. A hole or aperture 22 passes through the center of the upper face 20, and bumps 24A, 24B, 24C and 24D are arranged symmetrically about the upper thee 20. Bumps 24A and 24B are disposed along a diameter of the upper face 20 on opposite sides of and an equal distance from the hole 22. Similarly, bumps 24C and 24D are disposed along a diameter of the upper face 20 on opposite sides of and an equal distance from the hole 22. The diameters are perpendicular to each other.

The lip 14 extends above the upper face 20 to help retain balls that land on the upper face 20 of the target area 12. The lip 14 has notches or slots 26A, 26B, 26C and 26D that extend downwardly from an upper edge to provide more erratic ball action if a ball strikes a slot while the ball is in the air or rolling on the upper face 20. Slots 26A and 26B are aligned with a diameter of the upper face 20 on opposite sides of the hole 22. Similarly, slots 26C and 26D are aligned with a diameter of the upper face 20 on opposite sides of the hole 22. These diameters are perpendicular to each other. Further, a line passing through bumps 24A and 24B passes through the center of the upper face 20 at an angle of approximately 45° to a line passing through slots 26A and 26B.

The base 16 is disposed around and extends below the target area 12. Openings or vents 28 are provided through sides of the base 16 to provide a view of the balls 30A or 30B retained in a compartment 32 bounded by a lower face 34 of the target area 12, inner sides 36 of the base 16 and a portion of the playing surface 18 disposed under the base 16 and target area 12. The vents 28 also provide savings in material costs. A flange 38 extends around the circumference of the base 16 at the bottom of the base for stability. For added stability, the base 16 is frustoconical in shape, with the bottom having a larger diameter than the top, so that a side of the base 16 forms an angle of approximately 5° from vertical.

Figure 5:
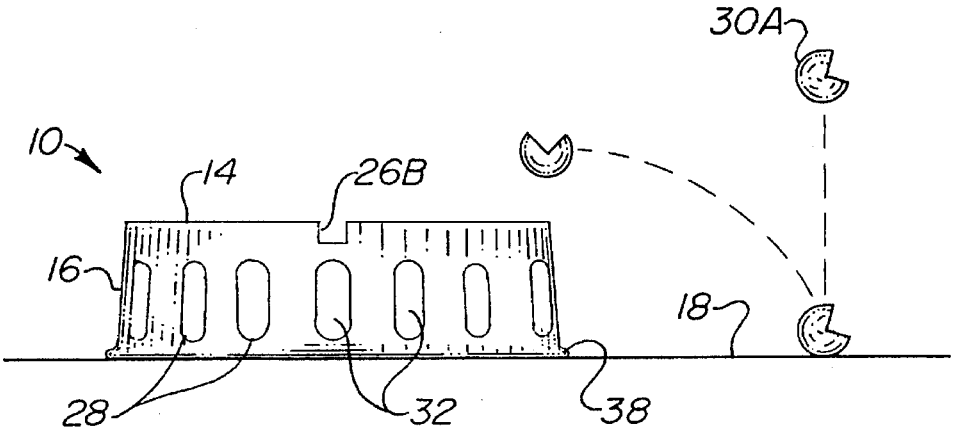
FIG. 5 is a side elevation view of an apparatus of the present invention showing a general path of an irregularly shaped ball.
Figure 6:
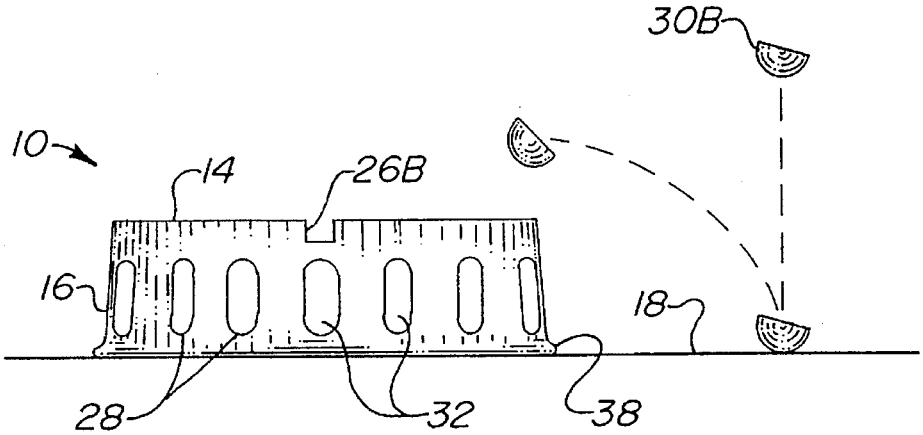
FIG. 6 is a side elevation view of an apparatus of the present invention showing a general path of an irregularly shaped ball.

Irregularly shaped balls, such as a ball in the shape of three-fourths of a sphere 30A or a ball in the shape of one-half of a sphere or a hemisphere 30B, are preferably used to provide an added degree of difficulty and unpredictability to the game. The balls 30A or 3013 are preferably made from molded rubber. As best shown in FIGS. 5 and 6, if properly positioned, the ball 30A or 30B when propelled substantially vertically toward the playing surface 18 with substantially no horizontal force, such as by releasing the ball or throwing the ball substantially vertically, the ball 30A or 30B will nonetheless bounce not only in a vertical direction but also in a horizontal direction toward the apparatus 10 and target area 12. As best shown in FIG. 5, a three-fourth sphere 30A is preferably held so that the one-fourth wedge faces away from the apparatus 10. A first face of the wedge is aligned substantially vertically or with an upper portion tilting slightly away from the apparatus 10. A second face of the wedge is disposed below the below the first face and is aligned substantially horizontally or with an outer portion tilting so that it is slightly below an inner portion of the second face of the wedge. A lower portion of the first face abuts an inner portion of the second face at a diameter of the three-fourth sphere, and that diameter is aligned substantially perpendicular to a diameter of the target area 12 or upper face 20.

As shown in FIG. 6, a one-half sphere 30B is preferably aligned so that a planar face of the ball is almost horizontal but so that a front edge of the face closest to the apparatus 10 is the highest edge, a rear edge of the face farthest from the apparatus is the lowest edge and the front edge is slightly higher than the rear edge. Altering the alignment of the ball 30A or 30B, the height from which it is dropped or thrown or the force with which it is propelled toward the playing surface 18 will affect the action of the ball. The game may be played in a relatively small area because a player need not back as far away from the apparatus 10 as would be required if the player were propelling the balls toward the playing surface 18 using more than a negligible amount of horizontal force.

The following preferred dimensions are given by way of illustration and should not be construed as limiting the scope of the invention. In the presently preferred indoor version, the apparatus 10 is approximately 3.75" tall, and the target area 12 has a diameter of approximately 12". The lip 14 extends approximately ⅝" above the upper face 20 and has four rectangular slots 26A, 26B, 26C and 26D, each having a width of approximately ¾". Four semi-spherical bumps 24A, 24B, 24C and 24D having a diameter of approximately 1" at the upper face 20 extend approximately ⅛" above the upper face 20. The hole 22 has a diameter of approximately 2¼", and the balls 30A or 30B have a diameter of approximately 1⅝" (if the irregularly shaped balls formed a complete sphere, the balls would have a maximum diameter of approximately 1⅝").

In the presently preferred outdoor version, the apparatus 10 is approximately 8" tall, and the target area 12 has a diameter of approximately 23". The lip 14 extends approximately ¾" above the upper face 20 and has six rectangular slots, each having a width of approximately 1". Six semi-spherical bumps having a diameter of approximately 1" at the upper face 20 extend approximately ⅛" above the upper face 20. The hole 22 has a diameter of approximately 3", and the balls 30A or 30B have a diameter of approximately 2".

Although the apparatus 10 is described in terms of components such as a target area 12, a lip 14, a base 16 and bumps 24A, 24B, 24C and 24D, it is preferred that the apparatus 10 be a single, unitary piece, such as a piece of molded plastic formed by injection molding.

Any number of games may be played or rules may be developed using the above apparatus 10 and balls 30A or 30B. The following are examples of games that might be played.

In game 1, each player gets five balls 30A or 30B, with each player having balls of a particular, distinct color. Players alternate turns in a clockwise fashion with each player bouncing one ball 30A or 30B per turn. Each player bounces a ball 30A or 30B in tum on the playing surface 18 in an effort to bounce the ball through the hole 22 and into the compartment 32, in an effort to bounce the ball so that it remains on the upper face 20, or in an effort to knock another player's ball 30A or 30B from the upper face 20. Balls 30A or 30B that pass through the hole 22 and remain in the compartment 32, regardless of whether they are bounced in or knocked in during a later turn, are assigned a higher point value than balls that remain on the upper face 20 of the target area 12. Balls 30A or 30B that fall from or that are knocked from the apparatus 10 have no point value, and bonus 5points are awarded to any player that places all five balls either in the compartment 32 or on the upper face 20 of the target area 12. After each player has played his or her 5 balls, the players total their scores, retrieve their balls and begin another round, rotating the beginning play to the next player in a clockwise fashion. Play continues until a predetermined winning score is reached or until a predetermined time passes, in which case, the high score at the expiration of the time period wins.

Game 2 involves simultaneous play. Each player gets 5 balls 30A or 30B of a particular, distinct color. When all players are ready, a player signals the beginning of play, and each player begins to bounce his or her balls 30A or 30B toward the apparatus 10 in an effort to get the balls into the compartment 32. In a round, each player may play or bounce each of his or her balls 30A or 30B only once. Each player is positioned with a slot between the player and the hole 22 and, before bouncing a ball 30A or 30B, must align his or her ball with a line passing from the center of the hole 22 through the slot. After each player has bounced each of his or her balls 30A or 30B, the players retrieve their balls that are not in the compartment 32 and prepare for the next round. When all players are ready, a player again signals the beginning of play, and another round is played. Play continues in this fashion until a winning player gets all of his or her balls 30A or 30B into the compartment 32.

In game 3, the object of the game is to get balls 30A or 30B into the compartment 32. Play progresses as in game 1 except that points are awarded only for balls that are placed into the compartment 32.

In game 4, the apparatus 10 is placed on a hard surface, such as a floor, and the object of the game is to drop a ball 30A or 30B from approximately waist level into the compartment 32 so that the ball remains in the compartment. As with games 1 and 3, each player gets 5 balls 30A or 30B, and play rotates in a clockwise fashion. After the first round in which each player has dropped all 5 of his or her balls 30A or 30B, the players retrieve all of their balls that have not remained in the compartment 32, and the next round begins with the beginning play rotating to the next player in a clockwise fashion. Play continues until one player gets all of his or her balls 30A or 30B into the compartment 32.

Other modifications, changes and substitutions are intended in the foregoing, and in some instances, some features of the invention will be employed without a corresponding use of other features. For example, although the apparatus 10 and games are described with reference to irregularly shaped balls 30A or 30B, spherical balls, or balls or game pieces of virtually any size, shape or composition may be used in connection with the apparatus 10. Further, although the apparatus 10 is described as having a lip 14, bumps 24A, 24B, 24C and 24D and slots 26A, 26B, 26C and 26D, these features may be used in any combination, may not be used at all or may take any number of shapes or sizes. Also, although the ball 30A or 30B is described as being molded rubber, any number of known materials may be used. Similarly, although the apparatus 10 is described as being made from molded plastic, it may also be made from any number of known materials and may be formed as a unitary piece or may be assembled from separate component pieces. Of course, the various dimensions, sizes and angles, as well as the number and arrangement of holes, slots and bumps, are given by way of illustration and should not be viewed as limiting the scope of the invention. Accordingly, it is appropriate that the appended claims be construed broadly and in a manner consistent with the scope of the invention.

I claim:

1. A game apparatus, comprising:

a target area having an upper face and an aperture passing therethrough;

a plurality of bumps disposed on said upper face;

a lip disposed about an outer edge of said target area and extending above said upper face, said lip having a plurality of slots extending downwardly from an upper edge of said lip; and a base secured to said target area for supporting said target area above a playing surface.

2. The game apparatus of claim 1 wherein said upper face is circular and is disposed substantially horizontally.

3. The game apparatus of claim 2 wherein said aperture is located at a center of said upper face.

4. The game apparatus of claim 3 wherein each of said plurality of bumps is disposed at a desired radius from said center.

5. The game apparatus of claim 4 wherein said plurality of bumps comprises first, second, third and fourth bumps, said first and second bumps being disposed along a first diameter of said upper face on opposite sides of and an equal distance from said center, said third and fourth bumps being disposed along a second diameter of said upper face on opposite sides of and an equal distance from said center, said first diameter being perpendicular to said second diameter.

6. The game apparatus of claim 4 wherein said plurality of slots comprises first, second, third and fourth slots, said first and second slots being aligned with a third diameter of said upper face on opposite sides of said center, said third and fourth slots being aligned with a fourth diameter of said upper face on opposite sides of said center, said third diameter being perpendicular to said fourth diameter.

7. The game apparatus of claim 6 wherein said first diameter passes through said center at an angle of approximately 45° to said third diameter.

8. The game apparatus of claim 1 wherein said base is frustoconical, a lower portion of said base having a larger diameter than an upper portion of said base.

9. The game apparatus of claim 8 wherein said base has a plurality of vents extending therethrough.

10. The game apparatus of claim 9 wherein a side of said base forms an angle of approximately 5° from vertical.

11. The game apparatus of claim 1 together with a ball comprising approximately three-fourths of a sphere.

12. The game apparatus of claim 1 together with a ball comprising approximately one-half of a sphere.

13. The combination of claim 11 wherein each of said plurality of slots has a width that is less than a diameter of said ball.

14. The combination of claim 12 wherein each of said plurality of slots has a width that is less than a diameter of said ball.

15. The game apparatus of claim 6 together with a ball comprising approximately three-fourths of a sphere.

16. The game apparatus of claim 9 together with a ball comprising approximately three-fourths of a sphere.

17. The combination of claim 16 wherein each of said plurality of vents has a width that is less than a diameter of said ball.

18. The game apparatus of claim 1 wherein each of said plurality of bumps has a height that is less than a height of said lip.

19. A method of playing a game, comprising:

(a) providing a game apparatus having a target area with an upper face having an aperture passing therethrough, and providing an irregularly shaped ball;

(b) holding said ball in a position so that when said ball is propelled toward a substantially flat playing surface with substantially no horizontal force, said ball will bounce in a desired direction toward said upper face of said target area; and (c) propelling said ball toward said playing surface with substantially no horizontal force in an effort to bounce said ball onto said upper face or through said aperture.

20. The method of claim 19 wherein said upper face is circular, and said game apparatus has a lip disposed about an outer edge of said target area and extending above said upper face, said lip having a slot extending downwardly from an upper edge of said lip; and further comprising, before step (c), aligning said ball with a line passing from a center of said upper face through said slot.

* * * * *

UNITED STATES PATENT AND TRADEMARK OFFICE

CERTIFICATE OF CORRECTION

PATENT NO. : 5,566,948
DATED : October 22, 1996
INVENTOR(S) : Bobby D. Kidd

It is certified that error appears in the above-indentified patent and that said Letters Patent is hereby corrected as shown below:

Title page, item [57],

In line 3 of the Abstract, "therethough" should be --therethrough--.

In line 12 of the Abstract, "towed" should be --toward--.

In column 2, line 31, "thee" should be --face--.

In column 3, line 2, "3013" should be --30B--.

In column 4, line 18, "5points" should be --points--.

Signed and Sealed this

Fourteenth Day of January, 1997

*Attest:*

BRUCE LEHMAN

*Attesting Officer*

*Commissioner of Patents and Trademarks*